United States Patent [19]

Chao

[11] Patent Number: 4,934,057

[45] Date of Patent: Jun. 19, 1990

[54] MULTI-BLADE PENCIL-CORE SHARPENER

[76] Inventor: Wen K. Chao, 47, Chung Cheng 1 Road, Ying Ko Town, Taipei Hsien, Taiwan, 239

[21] Appl. No.: 186,593

[22] Filed: Apr. 27, 1988

[51] Int. Cl.[5] ..... B26B 23/00

[52] U.S. Cl. ..... 30/457; 30/454; 30/460

[58] Field of Search ..... 30/453–455, 30/457, 460, 462

[56] References Cited

U.S. PATENT DOCUMENTS

| | | | |
|---|---|---|---|
| 749,011 | 1/1904 | Adams | 30/457 |
| 2,366,928 | 1/1945 | Paschell | 30/457 |

*Primary Examiner*—Douglas D. Watts

[57] ABSTRACT

A sharpener, specially for the pencils, is made of a shell and a metal blade. At the upper end of the shell there is a funnel or alternatively two funnels placed side by side. The metal blade is V-notched or U-notched with the opening upward and is placed in the middle of the single funnel or in-between of the two funnels alternatively. The pencil core can be sharpened on the edge (sharped or right-angled) of the notch.

14 Claims, 3 Drawing Sheets

MULTI-BLADE PENCIL-CORE SHARPENER

BACKGROUND OF THE INVENTION

A sharpener is newly designed specially for sharpening the core of a pencil. The conventional pencil sharpener of manual-operated type usually has only one blade equiped on the device. Hence the blade is easily dulled and its durability is therefore limited. However the present invention has many blades or right-angle edges equiped on the device for sharpening purpose. So it can last a much longer time than the conventional one can do.

SUMMARY

The present invention consists mainly of a shell, a V-notched or an alternative U-notched metal piece. There is a funnel or two funnels (placed side by side) in the upper part of the shell. The metal piece (the opening of the notch being upward) is fixed at the middle of the single funnel or alternatively in-between of the two funnels. The pencil can be inset into the mouth of the single funnel or alternatively into one mouth of the two side-by-side funnels. The pencil now can be turned clockwise or counterclockwise as desired meanwhile the core of the pencil is also truned and sharpened on one of the two edges of the V-notch or alternatively on one of the four edges of the U-notch till the sharpness as required is obtained. Therefore the present invention is really an advanced, novel, practical and multi-functioned device.

The main object of the present invention is to save the lead core of the pencil and lengthen the time of use of the pencil. The present invention can be easily and delicately controlled when it is in use. Therefore the present invention will cut much less lead core each time than the conventional sharpener will do; The second object of the present invention is to increase the efficiency of the utility. The present invention can be put or carried any where, as in the pocket or handbag since it is very small. So it can be used any time when the pencil is dulled and one can keep his pencil as sharp as needed all the time. If without present invention, one must go to the place where the sharpener is when his pencil is very dull; The third object of the present invention is that it can be loosely mounted on the upper end of the pencil and can be taken off any time for sharpening. It can also be mounted on the upper end of an "automatic pencil" (a pancil with its lead core being able controlled and reloaded by the user). If the "automatic pencil" is equiped with an eraser at its upper end, then the present invention can be fixed to one end of the eraser and they become one independent part. It can be fixed to the upper end of the "automatic pencil" with the eraser outside of the pencil as being a usual eraser end and the sharpener inside the pencil. It can also be taken off when the sharpener is needed; The fourth object of the present invention is that the length of the lead core sharpened can be adjusted in two stages, one longer, one shorter, by the unevenly designed funnel mouths in the Bi-side type.

BRIEF DESCRIPTION OF THE DRAWINGS

FIG. 3D'. The front view of the U-noteched thick blade used in the bi-side type.

FIG. 4D'. The side view of the U-notched thick blade used in the bi-side type.

The names with their designated numbers of the members or parts of the embodiment of the present invention used in the figures are listed below:

1. Central-type shell,
2. Bi-side type shell,
3. V-notched thin blade (sharp edged),
4. V-notched thick blade (right-angle edged),
5. U-notched thick blade (right-angle edged).
6. Central-type funnel.
7. Bi-side type funnels.
8. Thin blade receiving trough.
9. Thick blade receiving trough.
10. Central-type funnel mouth.
11. Bi-side type funnel mouth.
12. Central type V notch (right-angle edged).
13. Bi-side type V notch (right angle edged).
14. Bi-side type U notch (right-angle edged).
15. Lead powder outlet.
16. Fringe.
17. Pencil core.

Referring to the figures, the detailed construction of the present invention is described as follows.

The present invention has two types, the "Central type" and "Bi-side type". For the central type, the pencil is inset at the central point of the V-notched or U-notched thin blade and is sharpened by the edges of the notch (sharp edged); For the bi-side type, the pencil is inset one of the two slant funnel and is sharpened by the edges of the notch (right-angle edged) which is placed in-between of the two slant funnels.

Figure 1E:
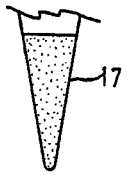
FIG. 1E. Dulled lead core of a pencil and being going to be sharpened.
Figure 1D:
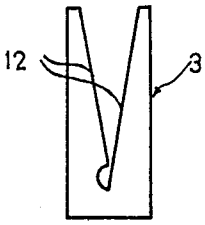
FIG. 1D. The front view of the V-notched thin blade used in the central type.
Figure 2D:
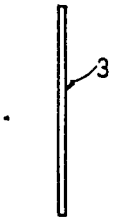
FIG. 2D. Side view of the V-notched thin blade used in central type.
Figure 3D:
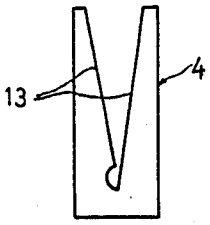
Figure 1C:
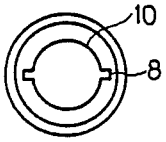
FIG. 1C. The top view of the present invention for the central-type shell.
Figure 1B:
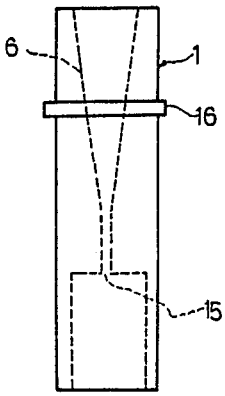
FIG. 1B. The front view of the embodiment of the present invention for the central-type shell (The dotted lines indicating the structure of the inner parts).
Figure 2B:
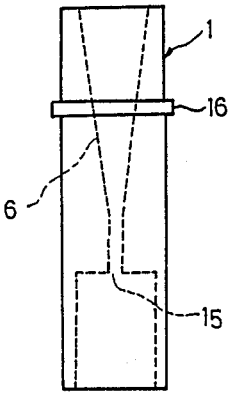
FIG. 2B. Side view of the central-type shell.
Figure 3B:
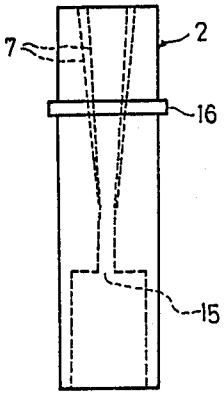
FIG. 3B. The front view of the bi-side type shell.

Inside the upper part of the central-type shell 1 there is a central-type funnel 6 (see FIGS. 1B, 2B and 1C).

Figure 1A:
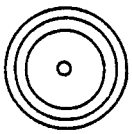
FIG. 1A. The bottom view of the embodiment of the present invention for the central-type shell (The dotted lines indicating the related parts in different figures, thereafter being the same).
Figure 3A:
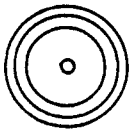
FIG. 3A. The bottom view of the bi-side type shell.

The pencil can be inset into this funnel 6 to be sharpened. The knife blade used in the central type is a V-notched thin blade (sharp edged) 3 (see FIGS. 1D and 2D) with a V notch 12 at the middle of the blade. The V-notched thin blade 3 is inset, through the central-type funnel mouth and along the thin blade receiving trough 8, into the single funnel with the upper portion of the knife blade outside of the shell 1. The two inclined edges of the V notch 12 are exactly coincident with the slope of slant wall of the funnel 6. The pencil can be inset into the funnel 6 and turned by hand, the pencil core 17 can be sharpened on the edge of the V notch 12. The pencil core 17 can be turned clockwise or counter-clockwise as desired because there is a sharp blade on either side of the V notch 12 (there are two sharp blades in total) (see FIGS. 1D, 1E). FIGS. 1A and 1C show the bottom view and top view of the central-type shell 1 respectively.

Figure 3D:
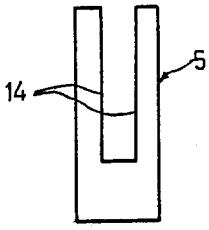
FIG. 3D. The front view of the v-notched thick blade used in the bi-side type.
Figure 4D:
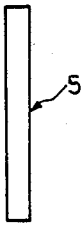
FIG. 4D. The side view of the V-notched thick blade used in the bi-side type.
Figure 4D:
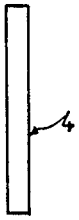
Figure 3C:
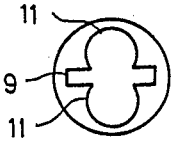
FIG. 3C. The top view of the bi-side type shell.
Figure 4B:
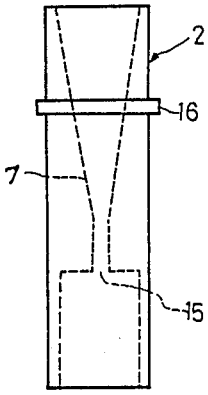
FIG. 4B. The side view of the bi-side type shell.

The other type of the present invention is the bi-side type. It is shown in the FIGS. 3, 4, and 5. Inside the upper part of the bi-side type shell 2 there are two bi-side type funnels 7 (see FIGS. 3B, 3C, 4B, and 5). The two funnels 7 are not quite complete circles but placed side by side with a minor part overlapped and separated either by the V-notched thick blade (right-angle edged) 4 or by the U-notched thick blade (right-angle edged) 5. There is only one bi-side type shell 2. The V-notched thick blade 4 or the U-notched thick blade 5 can alternatively be inset, through the bi-side type funnel mouth 11 and along the thick blade receiving trough 9, in-between of the two slightly slant funnels 7 (see FIGS. 3C and 5). The pencil can be inset into any one of the funnels 7 and turned by hand, the pencil core 17 can be sharpened on any one edge of the V notch 13 or U notch 14 of the thick blade 4 or 5 respectively. The notch (or cut) 13 on the thick blade 4 and the notch (or cut) 14 on the thick blade 5 are different in shape. The notch 13 is "V" shaped, and the notch 14 is "U" shaped, in order to meet the required sharpness of the pencil core 17. The V-notched thick blade 4 can be applied to the acute pencil point, otherwise the U-notched thick blade 5 is needed (see FIGS. 3D, 5, and 3D' respectively). The thick blades 4 and the thin blade 3 are different in structure. The thickness of the thin blade 3 is small (see FIG. 2D), there is a sharp edge on either side of the V notch 12, then the pencil core 17 is sharpened on these sharp edges. The thickness of the thick blade 4 and 5 is relatively large (see FIGS. 4D, 4D' and 5). The notch 13, or 14 on the thick blade 4 or 5 (including the V notch and U notch) respectively is not sharp edged but right-angle edged due to its thickness. Therefore there are two right-angle edges on each side of the notch 13 or 14, and 4 right-angle edges in total for each blade 13 or 14. The pencil core 17 is sharpened on any one or the righ-angle edges, turning clockwise or counter-clockwise as designed, till as sharp as needed. Thus four edges are provided for sharpening use in this device, consequently the "use life" of the present invention can four times than that of the conventional sharpener. It is a significant characteristic of the present invention.

After sharpening, the lead powder can flow out through the lead powder outlet 15 and then pour it into the rubblish can.

The present invention can be manufactured as an independent device as a usual sharpener or as a part of the ordinary pencil or "automatic pencil". For the ordinary pencil the present invention is be firmly fixed to its upper end, and for the "automatic pencil" the present invention is loosely mounted onto its upper end in order to be taken off when sharpening is needed. If there is an eraser mounted at the upper end of the "automatic pencil" originally, then the present invention can be fixed to one end of the eraser as an independent part as described previously. Then it can be mounted back to the upper end of the "automatic pencil" with the eraser-end outside the pencil as originally equiped and with the sharpener-end inside the hollowed portion of the pencil. However this independent part can be taken off from the pencil and then the sharpener-end is exposed and is ready for sharpening use. The independent part (one eraser-end and one sharpener-end) can be mounted to the upper end of the "automatic pencil" to the proper position by the help of the fringe 16.

Figure 5:
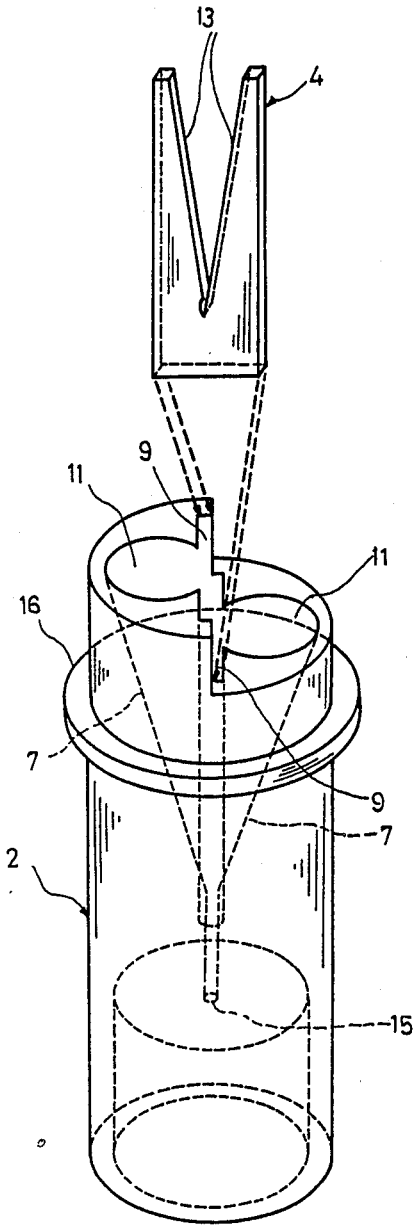
FIG. 5. The persperctive view of the embodiment of the present invention for the bi-side type (The mouth of each funnel being unevenly designed).
Figure 6:
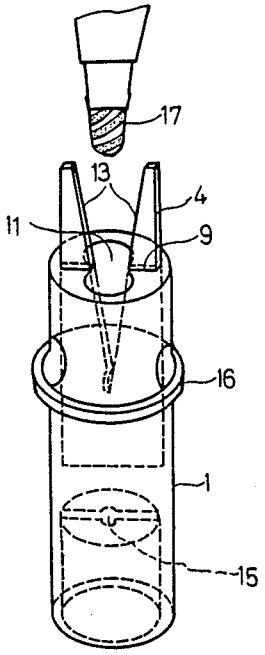
FIG. 6. The perspective view of bi-side type with a dulled pencil to be sharpened on top.
Figure 8A:
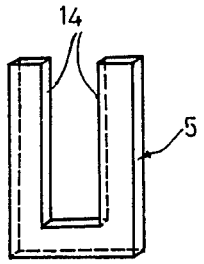
FIGS. 8 and 8A. The U-notched and V-notched thick blade.
Figure 8:
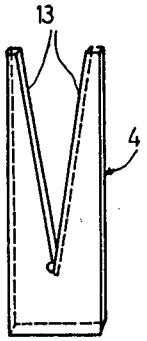
Figure 7:
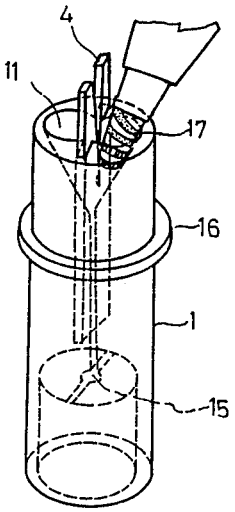
FIG. 7. The perspective view of bi-side type with a dulled pencil to be sharpened on the half way being inset into one of the two funnels.
Figure 10:
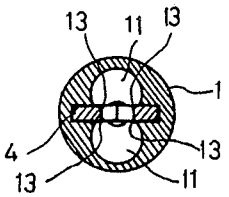
Figure 9:
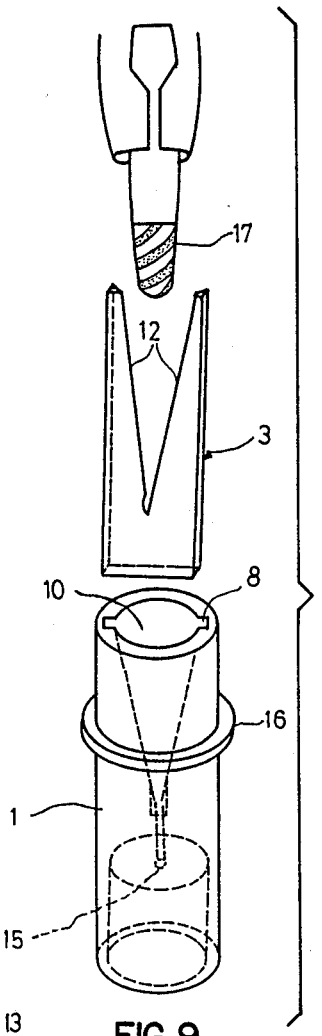
FIG. 9. The assembly of the present invention for the central type.

FIG. 5 shows the perspective view of the embodiment of the present invention. It is approximately the three-dimensional view of the FIG. 3 but with slight difference. The two funnel mouths 11 are even in height in FIG. 3 but uneven in FIG. 5 in order to sharpen the different size of the pencil core 17. Therefore the bi-side of the present invention can be subdivided into two types, the even-height funnel and the uneven-height funnel.

The FIGS. 6 through 9 give more detailed illustration by three-dimensional views. They are self-explanatory and their titles are listed in section 5 ("Brief Description of the Drawings").

The V-notched or U-notched blade 3, 4, or 5 can be made of pottery instead of metal if the edges of the notch are sufficiently acute.

I claim:

1. A sharpener for sharpening leads of pencils comprising an elongate shell defining a central axis and a first plane co-extensive with and containing said central axis; two conical funnel-shaped cavities provided in said shell defining conical axes inclined on opposite sides of said first plane and converging to substantially intersect in said first plane at a point intermediate to the ends of said shell and form circular openings on opposite sides of said first plane at one end of said shell; a blade mounted in said shell in a second plane substantially normal to said first plane and having cutting edges projecting into said cavities to contact a lead to be sharpened when placed into either cavity; and discharge means proximate to said intermediate point for discharging lead powder formed in either of said cavities.

2. A sharpener as defined in claim 1, wherein said elongate shell is generally cylindrical in shape.

3. A sharpener as defined in claim 1, wherein two receiving troughs or grooves are provided in said second plane on opposite sides of said cavities for receiving said blade.

4. A sharpener as defined in claim 1, wherein said conical axes are inclined relative to said first plane to cause the circular openings of said cavities formed at said one end of said shell to at least partially overlap at said second plane.

5. A sharpener as defined in claim 1, wherein said blade is made of metal.

6. A sharpener as defined in claim 1, wherein said blade is V-shaped to correspond to the taper or inclination of the inner surfaces of said cavities.

7. A sharpener as defined in claim 1, wherein said blade is U-shaped.

8. A sharpener as defined in claim 1, wherein said blade has a thickness to create two cutting surfaces at each edge due to the arrangement of surfaces at right angles.

9. A sharpener as defined in claim 8, wherein two edges are provided to thereby form a total of four cutting surfaces.

10. A sharpener as defined in claim 1, wherein said cavities have equal axial lengths to form equal sized lead receiving cavities.

11. A sharpener as defined in claim 1, wherein said sleeve has different axial lengths on opposite sides of said first plane, and said cavities have different lengths, whereby said cavities can be used to sharpen leads of different lengths.

12. A sharpener as defined in claim 1, wherein said discharge means comprises a hole from which lead powder can flow.

13. A sharpener as defined in claim 1, including means for attaching said shell to a writing implement.

14. A sharpener for sharpening leads of pencils comprising an elongate shell defining a central axis and a first plane co-extensive with and containing said central axis, a conical funnel-shaped cavity defining a conical axis inclined on one side of said first plane to intersect said first plane at a point intermediate to the ends of said shell and forming a circular opening on said one side of said first plane; a blade mounted in said shell in a second plane substantially normal to said first plane and having cutting edges projecting into said cavity to contact a lead to be sharpened when placed into said cavity; and discharge means proximate to said intermediate point for discharging lead powder formed in said cavity.

* * * * *